US006750184B2

(12) United States Patent
Ribeaud et al.

(10) Patent No.: US 6,750,184 B2
(45) Date of Patent: Jun. 15, 2004

(54) LUBRICANTS WITH 5-TERT.-BUTYL-4-HYDROXY-3-METHYLPHENYL SUBSTITUTED FATTY ACID ESTERS

(75) Inventors: Marc Ribeaud, Delémont (CH); Paul Dubs, Cham (CH); Serge Laemlin, Hombourg (FR)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 09/956,317

(22) Filed: Sep. 19, 2001

(65) Prior Publication Data

US 2002/0065201 A1 May 30, 2002

(30) Foreign Application Priority Data

Sep. 21, 2000 (EP) ..... 00810864

(51) Int. Cl.[7] ..... C10M 141/10; C10M 141/00

(52) U.S. Cl. ..... 508/375; 508/378; 508/501; 508/503; 508/563

(58) Field of Search ..... 508/375, 502, 508/563

(56) References Cited

U.S. PATENT DOCUMENTS 4,269,720 A * 5/1981 Bartleson et al. ..... 508/550
4,681,694 A * 7/1987 Zoleski et al. ..... 508/375
5,091,099 A 2/1992 Evans et al. ..... 252/48.6
5,880,073 A * 3/1999 Tomizawa et al. ..... 508/383

FOREIGN PATENT DOCUMENTS

| | | |
|---|---|---|
| EP | 0716141 | 6/1996 |
| EP | 0 781834 A2 * | 12/1996 |
| EP | 0781834 | 7/1997 |
| EP | 0896050 | 2/1999 |
| JP | 11209777 | 8/1999 |
| WO | 99/43762 | 9/1999 |

* cited by examiner

*Primary Examiner*—Ellen M McAvoy
(74) *Attorney, Agent, or Firm*—Kevin T. Mansfield

(57) ABSTRACT

The present invention relates to improved lubricant compositions highly resistant to oxidative degradation comprising selected 5-tert.-butyl-4hydroxy-3-methylphenyl substituted fatty acid esters, diphenylamines and zinc dithiophosphates. The compositions as defined above are characterized by superior antioxidative properties. This can be demonstrated in various standard tests such as Deposit and Oxidation Panel Test (DOPT) and Pressurized Differential Scanning Calorimetry (PDSC).

8 Claims, No Drawings

LUBRICANTS WITH 5-TERT.-BUTYL-4-HYDROXY-3-METHYLPHENYL SUBSTITUTED FATTY ACID ESTERS

The present invention relates to improved lubricant compositions, which are highly resistant to oxidative degradation, and which comprise selected phenolic and amine antioxidants. The invention also relates to the use of these lubricant compositions for improving the performance properties of lubricants, such as greases, metalworking fluids, gear fluids and hydraulic fluids.

It is known that additives improve the performance properties of lubricants, such as mineral oils or synthetic or semi-synthetic oils. Particularly additives are highly desirable which reduce the formation of oxidative degradation products and promote a long shelf life and high performance stability of lubricants.

The technical requirements for modern motor oils under the conditions of high temperature oxidation, as expressed by recent technical specifications, have become more severe. According to recent developments in the construction of combustion engines, particularly spark ignition internal combustion engines, higher amounts of nitrogen oxides ($NO_x$) are produced which reenter the crankcase as blow-by gases.

The lubricating oil also functions in the combustion chamber as a tight seal between the up-stroke of the piston and the cylinder head resulting in a contamination with high-boiling fuel components. These functions deteriorate in the presence of $NO_x$-gases.

Blow-by gases with increasing $NO_x$-content enhance the susceptibility of the lubricating oil to oxidation and the formation of undesirable oxidation products. Nuclei for deposits are formed which ultimately generate undesirable deposits, popularly known as black sludge. It is assumed that this degradation process is caused by $NO_x$-initiated autooxidation of the lubricating oil. Many attempts have been made to improve the performance of lubricating oils by the addition of different antioxidants.

EP-A-0 346 283 discloses phosphite-free lubricating oil compositions which comprise, among others, phenolic antioxidants in combination with different aromatic amines and mixtures of these amines. So-called sterically hindered phenolic antioxidants are specifically disclosed wherein the phenolic group is substituted in 3- and 5-position with tert.-butyl groups.

EP-A-0 781 834 discloses lubricating oil compositions which comprise 5-tert.-butyl-4-hydroxy-3-methylphenyl substituted fatty acid ester in combination with conventional oil additives other than diphenylamines.

The Japanese Published Patent Application Hei 11-209777 discloses lubricating oil compositions which comprise 3-(5-tert.-butyl-4-hydroxy-3-methylphenyl) propionic acid $C_5$- and -$C_{13}$alkyl esters in combination with alkylated diphenylamines. No additional additives are specifically disclosed. The composition is used for preventing the discoloration of lubricating oils. No other technical uses and applications or improved antioxidative properties are disclosed.

EP-A-0 896 050 discloses lubricating oil compositions which comprise a large group of different phenolic antioxidants of divergent structures in combination with different aromatic amines and sulfur containing oil additives. Among them zinc dithiophosphates are disclosed.

Novel lubricant compositions have now been found which possess improved antioxidative properties as compared with the prior art compositions. The novel lubricant compositions comprise a selected group of 5-tert.-butyl-4-hydroxy-3-methylphenyl substituted fatty acid esters in combination with specific diphenylamines and zinc dithiophosphates. The novel lubricant compositions are highly resistant to oxidative degradation and are capable of reducing the negative effects of deposits, such as black sludge, in motor combustion engines, particularly spark ignition internal combustion engines.

The present invention relates to a composition, which comprises:

a) a base oil of lubricating viscosity;

b) at least one phenol of the formula:

(I)

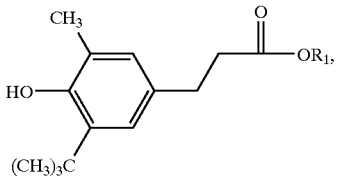

wherein $R_1$ represents branched $C_8$-$C_{22}$alkyl;

c) at least one aromatic amine of the formula:

(II)

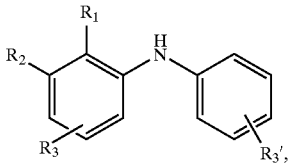

wherein $R_1$ and $R_2$ represent hydrogen or together represent the group:

(A)

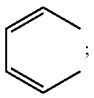

and one of $R_3$ and $R_3$' represents hydrogen and the other one $C_2$–$C_{30}$alkyl or both $R_3$ and $R_3$' represent $C_2$–$C_{30}$alkyl; and d) at least one zinc dithiophosphate of the formula (III)

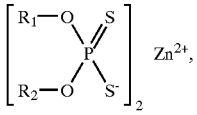

wherein $R_1$ and $R_2$represent straight chained or branched $C_3$–$C_{20}$alkyl.

The compositions defined above containing 5-tert.-butyl-4-hydroxy-3-methylphenyl substituted fatty acid esters are characterized by their superior antioxidative properties as compared with the corresponding compositions containing 3,5-di-tert.-butyl-4-hydroxyphenyl substituted fatty acid esters. This can be demonstrated in various commonly accepted tests such as Deposit and Oxidation Panel Test (DOPT) and Pressurized Differential Scanning Calorimetry (PDSC).

The compositions according to the instant invention are particularly suitable for use as lubricants having excellent antioxidative properties in internal combustion engines, such as spark-ignition internal combustion engines (popularly known as Otto motor engines) or self-ignition internal combustion engines (popularly known as Diesel motor engines).

The compositions are particularly suitable as motor oils which correspond in the API (American Petroleum Institute) classification to the categories SF, SG and CD, in the CRC (Coordinating Research Council) classification to the standardized Caterpillar Tests 1-G 1 or 1-G 2 and in the CCMC (Committee of Common Market Automobile Constructors) classification to the specifications G 1, G 2, G 3, D 1, D 2, D 3 and/or PD 1.

The definitions and general terms used in the description of the present invention preferably have the following meanings:

Component a)

A base oil of lubricating viscosity can be used for the preparation of engine oils, gear fluids, or hydraulic fluids, but also for fuel additives, greases or metal working fluids.

Suitable engine oils, gear fluids and hydraulic fluids are based, for example, on mineral oils or synthetic oils or mixtures thereof. The lubricants are known and familiar to the person skilled in the art and are described in standard reference books, such as in *Chemistry and Technology of Lubricants*; Mortier, R. M. and Orszulik, S. T. (Editors); 1992 Blackie and Son Ltd. for GB, VCH-Publishers N.Y. for U.S., ISBN 0-216-92921-0, pages 208 et seq. and 269 et seq.; in *Kirk-Othmer Encyclopedia of Chemical Technology*, Fourth Edition 1969, 1. Wiley & Sons, New York, Vol. 13, page 533 et seq. (Hydraulic Fluids); *Performance Testing of Hydraulic Fluids*; R. Tourret and E. P. Wright, Hyden & Son Ltd. GB, on behalf of The Institute of Petroleum London, ISBN 0 85501 317 6; *Ullmann's Encydopedia of Ind. Chem., Fifth Completely Revised Edition*, Verlag Chemie, DE-Weinheim, VCH-Publishers for U.S., Vol. A 15, page 423 et seq. (lubricants), Vol. A 13, page 165 et seq. (hydraulic fluids).

The base oil of lubricating viscosity is preferably a mineral oil derived lubricating base oil containing 80% by mass or more of a saturated hydrocarbon component. Various methods for producing the mineral oil derived lubricating base oil are available. For example, the lubricating base oil may be a paraffin oil or a naphthenic oil obtainable by subjecting a lubricating oil fraction derived from an atmospheric or vacuum distillation of crude oil to refining processes such as deasphalting, solvent refining such as solvent extraction with furfural, hydrocracking, solvent or catalytic dewaxing, such as solvent or catalytic dewaxing, hydrotreating, such as hydrocracking or hydrofinishing, clay treatment, such as washing with acid treated or activated clay, or chemical refining such as washing with caustic soda or sulfuric acid and the like. Combinations of these methods are also available for producing the mineral oil derived lubricating base oil.

Preferred methods for producing the mineral oil derived lubricating base oil consists of the following technical procedures, wherein one of the following oils is used as feedstock oil:

1) a distillate derived from the atmospheric distillation of a paraffin crude oil and/or a mixed crude oil;
2) a whole vacuum gas oil (WVGO) of a paraffin crude oil and/or a mixed crude oil;
3) an oil obtained by subjecting the product obtained according to 1) and/or 2) to mild hydrocracking (MHC);
4) a mixture of two or more selected from products obtained according to 1) to 3);
5) a deasphalted oil (DAO) from products obtained according to 1), 2), 3) or 4);
6) an oil obtained by subjecting the product obtained according to 5) to mild hydrocracking; and
7) a mixture of two or more oils selected from the group of oils obtained according to 1) through 6).

Either the feedstock oil itself or a lubricating oil fraction recovered therefrom is refined by conventional refining processes, such as the ones mentioned above, to obtain a lubricating oil fraction which is useful as the component a) of the claimed composition. The base oil may be present in the composition as an individual component or in a combination of two or more of the above-mentioned base oils.

Other base oils of lubricating viscosity are oils and greases, for example based on vegetable and animal oils, fats, tallow, wax and mixtures thereof. Vegetable and animal oils, fats, tallow and wax are, for example, palm-kernel oil, palm oil, olive oil, rapeseed oil, rape oil, linseed oil, soybean oil, cottonseed oil, sunflower oil, coconut oil, maize oil, castor oil, low-grade olive oil and mixtures thereof, fish oils, and also the chemically modified, for example epoxidized and sulfoxidized, forms thereof, or forms thereof produced by genetic engineering, for example genetically engineered soybean oil.

Examples of synthetic oils include lubricants based on aliphatic or aromatic carboxy esters, polymeric esters, polyalkylene oxides, phosphoric acid esters, poly-α-olefins or silicones, the diester of a divalent acid with a monohydric alcohol, such as, for example, dioctyl sebacate or dinonyl adipate, a triester of trimethylolpropane with a monovalent acid or with a mixture of such acids, such as, for example, trimethylolpropane tripelargonate, trimethylolpropane tricaprylate or mixtures thereof, a tetraester of pentaerythritol with a monovalent acid or with a mixture of such acids, such as pentaerythritol tetracaprylate, or a complex ester of monovalent and divalent acids with polyhydric alcohols, for example a complex ester of trimethylolpropane with caprylic and sebacic acid, or a mixture thereof. Apart from mineral oils, poly-α-olefins, ester-based lubricants, phosphates, glycols, polyglycols and polyalkylefne glycols, and also mixtures thereof with water are especially suitable.

An organic or inorganic thickener (base fat) may also be added to the above-mentioned lubricants or mixtures thereof. Metal-working fluids and hydraulic fluids may be prepared on the basis of the same substances as those described above for the lubricants, such fluids frequently being emulsions of such substances in water or other liquids.

Component b)

In the compound of the formula I, $R_1$ is defined as branched $C_8$-$C_{22}$alkyl, e.g. isooctyl types, e.g. 3,4-, 3,5- or 4,5-dimethyl-1-hexyl or 3- or 5-methyl-1-heptyl, other branched octyl types such as 1,1,3,3-tetramethylbutyl or 2-ethylhexyl, or branched alkyl groups with more than 8 carbon atoms, e.g. 1,1,3-trimethylhexyl, 1-methylundecyl, 2-n-butyl-n-octyl, isotridecyl, 2-n-hexyl-n-decyl or 2-n-octyl-n-dodecyl.

In a particularly preferred embodiment of the invention $R_1$ consists of isooctyl types selected from the group consisting of 3,4-, 3,5- or 4,5-dimethyl-1-hexyl and 3- or 5-methyl-1-heptyl, or branched alkyl groups with more than 8 carbon atoms wherein a side chain is attached in 2-position of the carbon chain, e.g. 2-n-butyl-n-octyl, 2-n-hexyl-n-decyl or 2-n-octyl-n-do-decyl.

Compounds of the formula I are known and may be prepared by any known process, for instance a 6-tert.-butyl-2-methylphenol reacts with a methylacrylate in the presence of a strong basic catalyst, such as metallic sodium thus producing methyl 3-(5-tert.-butyl-4-hydroxy-3-methylphenyl)propionate. This ester is then subjected to a transesterification reaction with the corresponding $C_8$-$C_{22}$alkanols.

Some compounds of the formula I are commercially available, e.g. under the names Exxal® (Exxon Corporation) 8, 9, 10, 11, 12, 13, Acropol® 35 or Isofol® (Condea) 12, 14, 16, 18, 20.

Component b) may consist of one individual compound (I) as defined above or may be present in the composition as mixture of two or more compounds defined by the formula I. The total content of component b) in the composition is in the range between 0.1 and 10.0, preferably 0.2 and 5.0, and even more preferably 0.2 and 3.0 percent by mass based on the total weight of the composition.

Component c)

In a compound of the formula II $R_1$ and $R_2$ represent hydrogen or together represent the group A. In the event that $R_1$ and $R_2$ together represent the group (A)

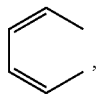

the compound of the formula II has the following structural formula

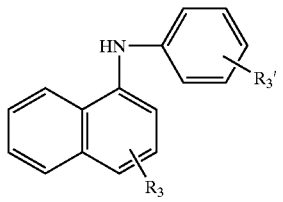

In this embodiment $R_3$ preferably is hydrogen and $R_3'$ represents $C_2$–$C_{30}$alkyl. $R_3'$ preferably is in the 4-position of the phenyl ring.

$R_3$ and $R_3'$ defined as $C_2$–$C_{30}$alkyl is ethyl or straight chained or branched $C_3$–$C_{30}$alkyl, e.g. n-propyl, isopropyl, n-, iso- or tert.-Butyl, n-pentyl, isoamyl, neopentyl, 2-ethylbutyl, n-hexyl, 1-methylpentyl, 1,3-dimethylbutyl, n-heptyl, isoheptyl, n-octyl, 1,4,4-trimethyl-2-pentyl, 3,4-, 3,5- or 4,5-dimethyl-1-hexyl, 3- or 5-methyl-1-heptyl, 1,1, 3,3-tetramethylbutyl, 2-ethylhexyl, branched octyl as obtained from a dimer of isobutylene, n-nonyl, 1,1,3-trimethylhexyl, branched nonyl as obtained from a trimer of tripropylene, 1-methylundecyl, 2-n-butyl-n-octyl, branched dodecyl obtained from a trimer of isobutylene or a tetramer of propylene, branched pentadecyl obtained from a pentamer of propylene, 2-n-hexyl-n-decyl or 2-n-octyl-n-dodecyl.

In a preferred embodiment of the invention the aromatic amine has the formula (II'),

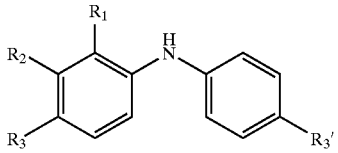

wherein $R_1$ and $R_2$ represent hydrogen or together represent the group (A) and one of $R_3$ and $R_3'$ represents hydrogen and the other one $C_8$–$C_{16}$alkyl or both $R_3$ and $R_3'$ represent $C_8$–$C_1$alkyl, preferably branched $C_8$–$C_{18}$alkyl as defined above. $R_3$ and $R_3'$ is preferably branched octyl as obtained from a dimer of isobutylene, branched nonyl as obtained from a trimer of tripropylene, branched dodecyl obtained from a trimer of isobutylene or a tetramer of propylene, or branched pentadecyl obtained from a pentamer of propylene.

In a particularly preferred embodiment of the invention the aromatic amine has the formula II', wherein $R_1$ and $R_2$ represent hydrogen or together represent the group (A) and one of $R_3$ and $R_3'$ represents hydrogen and the other one 1,4,4trimethyl-2-pentyl or straight chained or branched nonyl or both $R_3$ and $R_3'$ represent 1,4,4-trimethyl-2-pentyl or straight chained or branched nonyl.

Aromatic amines of the formulae II and II' are known and can be obtained by methods such as the ones described in EP-A-0 149 422. Some compounds of the formula II are commercially available, e.g. under the trade marks Irganox® (Ciba Specialty Chemicals) L 57 or L 06.

Component c) may consist of one individual compound (II) as defined above or may be present in the composition as a mixture of two or more compounds defined by the formula II, wherein the alkyl groups on the phenyl ring differ by their chain length.

Although the total content of the component c) in the composition is not critical, the preferred total content of component c) in the composition is in the range between 0.1 and 5.0, preferably 0.1 and 1.5 percent by mass based on the total weight of the composition.

Component d)

In the zinc dithiophosphate of the formula III $R_1$ and $R_2$ represent straight chained or branched $C_3$–$C_{20}$alkyl, e.g. isopropyl or $C_4$–$C_{20}$alkyl as defined above under component b). Particularly preferred groups $R_1$ and $R_2$ are isopropyl, sec.-butyl and tert.-butyl.

Zinc dithiophosphates of the formula III are known and commercially available, e.g. under the trademark Hitec® (Hitec Corp.) 769.

Although the total content of the component d) in the composition is not critical, the preferred total content of component c) in the composition is in the range between 0.1 and 5.0, preferably 0.3 and 1.5 percent by mass based on the total weight of the composition, or, in the alternative, between 0.01 and 0.1%, or, preferably, between 0.01 and 0.05%, as expressed as phosphorus content in the composition.

Optional Components: Component e)

The addition of at least one additional customary oil additive to the composition is optional but preferred. The mentioned lubricant compositions, e.g. greases, gear fluids, metal-working fluids and hydraulic fluids, may additionally comprise further additives that are added in order to improve their basic properties still further. Such additives include: further antioxidants, metal passivators, rust inhibitors, viscosity index enhancers, pour-point depressants, dispersants, detergents, further extreme-pressure additives and anti-wear additives. Such additives are added in the amounts customary for each of them, which range in each case approximately from 0.01 to 10.0%, preferably 0.1 to 1.0%, by weight. Examples of further additives are given below:

1. Examples of Phenolic Antioxidants:

1.1. Alkylated monophenols: 2,6-di-tert-butyl-4-methylphenol, 2-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(α-methylcyclohexyl)-4,6-dimethylphenol, 2,6-dioctadecyl-4-methylphenol, 2,4,6-tricyclohexylphenol, 2,6-di-tert-butyl-4-methoxymethylphenol, linear nonylphenols or nonylphenols branched in the side chain, such as, for example, 2,6-dinonyl-4-methylphenol, 2,4-dimethyl-6-(1'-methyl-undec-1'-yl)-phenol, 2,4-dimethyl-6-(1'-methylheptadec-1'-yl)-phenol, 2,4-dimethyl-6-(1'-methyltridec-1'-yl)-phenol and mixtures thereof;

1.2. Alkylthiomethylphenols: 2,4-dioctylthiomethyl-6-tert-butylphenol, 2,4-dioctylthiomethyl-6-methylphenol, 2,4-dioctylthiomethyl-6-ethylphenol, 2,6-didodecylthiomethyl-4-nonylphenol;

1.3. Hydroquinones and alkylated hydroquinones: 2,6-di-tert-butyl-4-methoxyphenol, 2,5-di-tert-butylhydroquinone, 2,5-di-tert-amylhydroquinone, 2,6-diphenyl-4-octadecyloxyphenol, 2,6-di-tert-butylhydroquinone, 2,5-di-tert-butyl-4-hydroxyanisole, 3,5-di-tert-butyl-4-hydroxyanisole, 3,5-di-tert-butyl-4-hydroxyphenyl stearate, bis (3,5-di-tert-butyl-4-hydroxyphenyl) adipate;

1.4. Tocopherols: α-, β-, γ or δ-tocopherol and mixtures thereof (vitamin E);

1.5. Hydroxylated thiodiphenyl ethers: 2,2'-thio-bis(6-tert-butyl-4-methylphenol), 2,2'-thio-bis (4-octylphenol), 4,4'-thio-bis(6-tert-butyl-3-methylphenol), 4,4'-thio-bis(6-tert-butyl-2-methylphenol), 4,4'-thio-bis(3,6-di-sec-amylphenol), 4,4'-bis(2,6-dimethyl-4-hydroxy-phenyl) disulfide;

1.6. Alkylidene bisphenols: 2,2'-methylene-bis (6-tert-butyl4-methylphenol), 2,2'-methylene-bis (6-tert-butyl-4-ethylphenol), 2,2'-methylene-bis [4-methyl-6-(α-methylcyclohexyl) phenol], 2,2'-methylene-bis (4-methyl-6-cyclohexylphenol), 2,2'-methylene-bis (6-nonyl-4-methylphenol), 2,2'-methylene-bis (4,6-di-tert-butylphenol), 2,2'-ethylidene-bis(4,6-di-tert-butylphenol), 2,2'-ethylidene-bis(6-tert-butyl-4-isobutylphenol), 2,2'-methylene-bis[6-(α-methylbenzyl)-4-nonylphenol], 2,2'-methylene-bis[6-(α,α-dimethyl-benzyl)-4-nonylphenol], 4,4'-methylene-bis(2,6-di-tert-butylphenol), 4,4'-methylene-bis(6-tert-butyl-2-methylphenol), 1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl)butane, 1,1-bis(5-tert-butyl-4-hydroxy-2-methylphenyl)-3-n-dodecylmercaptobutane, ethylene glycol bis[3,3-bis(3'-tert-butyl-4'-hydroxyphenyl)-butyrate], bis(3-tert-butyl-4-hydroxy-5-methylphenyl) dicyclopentadiene, bis[2-(3'-tert-butyl-2'-hydroxy-5'-methylbenzyl)-6-tert-butyl-4-methylphenyl]terephthalate, 1,1-bis(3,5-dimethyl-2-hydroxyphenyl)butane, 2,2-bis(3,5-di-tert-butyl-4-hydroxyphenyl)-propane, 2,2-bis(5-tert-butyl-4-hydroxy-2-methylphenyl)-4-n-dodecyl-mercaptobutane, 1,1,5,5-tetra(5-tert-butyl-4-hydroxy-2-methylphenyl)pentane;

1.7. O-. N- and S-benzyl compounds: 3,5,3',5'-tetra-tert-butyl-4,4'-dihydroxydibenzyl ether, octadecyl-4-hydroxy-3,5-dimethylbenzyl-mercaptoacetate, tridecyl-4-hydroxy-3,5-di-tert-butylbenzyl-mercaptoacetate, tris (3,5-di-tert-butyl-4-hydroxybenzyl)amine, bis(4-tert-butyl-3-hydroxy-2,6-dimethylbenzyl)dithioterephthalate, bis(3,5-di-tert-butyl-4-hydroxybenzyl)sulfide, isooctyl-3,5-di-tert-butyl-4-hydroxybenzyl-mercaptoacetate;

1.8. Hydroxybenzylated malonates: dioctadecyl-2,2-bis (3,5-di-tert-butyl-2-hydroxybenzyl)malonate, dioctadecyl-2-(3-tert-butyl-4-hydroxy-5-methylbenzyl)malonate, didodecyl-mercaptoethyl-2,2-bis(3,5-di-tert-butyl-4-hydroxybenzyl) malonate, di[4-(1,1,3,3-tetramethylbutyl)-phenyl]-2,2-bis(3,5-di-tert-butyl-4-hydroxybenzyl) malonate;

1.9. Hydroxybenzyl aromatic compounds: 1,3,5-tris(3,5-di-tert-butyl-4-hydroxybenzyl)-2,4,6-trimethylbenzene, 1,4-bis(3,5-di-tert-butyl-4-hydroxybenzyl)-2,3,5,6-tetramethylbenzene, 2,4,6-tris(3,5-di-tert-butyl-4-hydroxybenzyl)phenol;

1.10. Triazine compounds: 2,4-bis-octylmercapto-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis(3,5-di-tert-butyl-4-hydroxyphenoxy)-1,3,5-triazine, 2,4,6-tris (3,5-di-tert-butyl-4-hydroxyphenoxy)-1,2,3-triazine, 1,3,5-tris (3,5-di-tert-butyl-4-hydroxybenzyl)isocyanurate, 1,3,5-tris(4-tert-butyl-3-hydroxy-2,6-dimethylbenzyl) isocyanurate, 2,4,6-tris(3,5-di-tert-butyl-4-hydroxyphenylethyl)-1,3,5-triazine, 1,3,5-tris(3,5-di-tert-butyl-4-hydroxyphenylpropionyl)hexahydro-1,3,5-triazine, 1,3,5-tris(3,5-dicyclohexyl-4-hydroxybenzyl)isocyanurate;

1.11. Acylaminophenols: 4-hydroxylauric acid anilide, 4-hydroxystearic acid anilide, N-(3,5-di-tert-butyl-4-hydroxyphenyl)-carbamic acid octyl ester;

1.12. Esters of β-(5-tert-butyl-4-hydroxy-3-methylphenyl) propionic acid: with polyhydric alcohols, e.g. with 1,6-hexanediol, 1,9-nonanediol, ethylene glycol, 1,2-propanediol, neopentyl glycol, thiodiethylene glycol, diethylene glycol, triethylene glycol, pentaerythritol, tris (hydroxyethyl)isocyanurate, N,N'-bis (hydroxyethyl) oxalic acid diamide, 3-thiaundecanol, 3-thiapentadecanol, trimethylhexanediol, trimethylolpropane, 4-hydroxymethyl-1-phospha-2,6,7-trioxabicyclo[2.2.2]octane;

1.1 3. Esters of β-(3,5-di-tert-butyl-4-hydroxyphenyl) propionic acid, γ-(3,5-dicyclohexyl-4-hydroxyphenyl) propionic acid, 3,5-di-tert-butyl-4-hydroxyphenylacetic acid: with mono- or polyhydric alcohols, e.g. with methanol, ethanol, n-octanol, isooctanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis-hydroxyethyl oxalic acid diamide, 3-thiaundecanol, 3-thiapentadecanol, trimethylhexanediol, trimethylolpropane, 4-hydroxymethyl-1-phospha-2,6,7-trioxabicyclo[2.2.2]octane;

1.14. Amides of β-(3,5-di-tert-butyl-4-hydroxyphenyl) propionic acid: N,N'-bis (3,5-di-tert-butyl-4-hydroxyphenylpropionyl)hexamethylenediamine, N,N'-bis (3,5-di-tert-butyl-4-hydroxyphenylpropionyl) trimethylenediamine, N,N'-bis(3,5-di-tert-butyl-4-hydroxyphenylpropionyl)hydrazine;

1.15. Ascorbic acid (vitamin C);

1.1 6. Aminic antioxidants: N,N'-diisopropyl-p-phenylenediamine, N,N'-di-sec-butyl-p-phenylenediamine, N,N'-bis(1,4-dimethylpentyl)-p-phenylenediamine, N,N'-bis (1-ethyl-3-methylpentyl)-p-phenylenediamine, N,N'-bis(1-methylheptyl)-p-phenylenediamine, N,N'dicyclohexyl-p-phenylenediamine, N,N'-diphenyl-p-phenylenediamine, N,N'-di(naphth-2-yl)-p-phenylenediamine, N-isopropyl-N'-phenyl-p-phenylenediamine, N-(1,3-dimethylbutyl)-N'- phenyl-p-phenylenediamine, N-(1-methylheptyl)-N'-phenyl-p-phenylenediamine, N-cyclohexyl-N'-phenyl-p-phenylenediamine, 4-(p-toluenesulfonamido)-diphenylamine, N,N'-dimethyl-N,N'-di-sec-butyl-p-phenylenediamine, diphenylamine, N-allyldiphenylamine, 4-isopropoxydiphenylamine, 4-n-butylaminophenol, 4-butyrylaminophenol, 4-nonanoylaminophenol, 4-dodecanoylaminophenol, 4-octadecanoylaminophenol, di(4-methoxyphenyl)amine, 2,6-di-tert-butyl-4-dimethylaminomethyl phenol, 2,4'-diamino-diphenylmethane, 4,4'-diaminodiphenylmethane, N,N,N',N'-tetramethyl-4,4'-diaminodiphenylmethane, 1,2-di[(2-methylphenyl)amino]-ethane, 1,2-di(phenylamino)propane, (o-tolyl)biguanide, di[4-(1',3'-dimethylbutyl)phenyl]amine, tert-octylated N-phenyl-1-naphthylamine, mixture of mono- and di-alkylated tert-butyl/tert-octyl-diphenylamines, mixture of mono- and di-alkylated nonyldiphenylamines, mixture of mono- and di-alkylated dodecyldiphenylamines, mixture of mono- and di-alkylated isopropyl/isohexyl-diphenylamines, mixtures of mono- and di-alkylated tert-butyldiphenylamines, 2,3-dihydro-3,3-dimethyl-4H-1,4-benzothiazine, phenothiazine, mixture of mono- and di-alkylated tert-butyl/tert-octyl-phenothiazines, mixtures of mono- and di-alkylated tert-octylphenothiazines, N-allylphenothiazine, N,N,N',N'-tetraphenyl-1,4-diaminobut-2-ene, N,N-bis(2,2,6,6-tetramethylpiperidin-4-yl)hexamethylenediamine, bis(2,2,6,6-tetramethylpiperidin-4-yl)sebacate, 2,2,6,6-tetramethylpiperidin-4-one, 2,2,6,6-tetramethylpiperidin-4-ol.

2. Examples of further antioxidants: aliphatic or aromatic phosphites, esters of thiodipropionic acid or thiodiacetic acid or salts of dithiocarbamic acid, 2,2,12,12-tetramethyl-5,9-dihydroxy-3,7,11-trithiatridecane and 2,2,15,15-tetramethyl-5,12-dihydroxy-3,7,10,14-tetrathiahexadecane.

3. Examples of Metal Deactivators. e.g. for Copper:

3.1. Benzotriazoles and derivatives thereof: 2-mercaptobenzotriazole, 2,5-dimercaptobenzotriazole, 4- or 5-alkylbenzotriazoles (e.g. tolutriazole) and derivatives thereof, 4,5,6,7-tetrahydrobenzotriazole, 5,5'-methylene-bis-benzotriazole; Mannich bases of benzotriazole or tolutriazole, such as 1-[di(2-ethylhexyl) aminomethyl] tolutriazole and 1-[di(2-ethylhexyl)aminomethyl] benzotriazole; alkoxyalkylbenzotriazoles, such as 1-(nonyloxy-methyl)benzotriazole, 1-(1-butoxyethyl)-benzotriazole and 1-(1-cyclohexyloxybutyl)-tolutriazole;

3.2. 1,2,4-Triazoles and derivatives thereof: 3-alkyl-(or -aryl-) 1,2,4-triazoles, Mannich bases of 1,2,4-triazoles, such as 1-[di(2-ethylhexyl)aminomethyl]-1,2,4-triazole; alkoxyalkyl-1,2,4-triazoles, such as 1-(1-butoxyethyl)-1,2,4-triazole; acylated 3-amino-1,2,4-triazoles;

3.3. Imidazole derivatives: 4,4'-methylene-bis(2-undecyl-5-methyl) imidazole and bis [(N-methyl)imidazol-2-yl] carbinol-octyl ether;

3.4. Sulfur-containing heterocyclic compounds: 2-mercaptobenzothiazole, 2,5-dimercapto-1,3,4-thiadiazole, 2,5-dimercaptobenzothiadiazole and derivatives thereof; 3,5-bis [di(2-ethylhexyl)aminomethyl]-1,3,4-thiadiazolin-2-one;

3.5. Amino compounds: salicylidene-propylenediamine, salicylaminoguanidine and salts thereof.

4. Examples of Rust Inhibitors:

4.1. Organic acids, their esters, metal salts, amine salts and anhydrides: alkyl- and alkenylsuccinic acids and their partial esters with alcohols, diols or hydroxycarboxylic acids, partial amides of alkyl- and alkenyl-succinic acids, 4-nonylphenoxyacetic acid, alkoxy- and alkoxyethoxy-carboxylic acids, such as dodecyloxyacetic acid, dodecyloxy (ethoxy) acetic acid and amine salts thereof, and also N-oleoyl-sarcosine, sorbitan monooleate, lead naphthenate, alkenylsuccinic acid anhydrides, e.g. dodecenylsuccinic acid anhydride, 2-(2-carboxyethyl)-1-dodecyl-3-methylglycerol and salts thereof, especially sodium and triethanolamine salts thereof.

4.2. Nitrogen-containing Compounds:

4.2.1. Tertiary aliphatic or cycloaliphatic amines and amine salts of organic and inorganic acids, e.g. oil-soluble alkylammonium carboxylates, and 1-[N,N-bis(2-hydroxyethyl)amino]-3-(4-nonylphenoxy)propan-2-ol;

4.2.2. Heterocyclic compounds: substituted imidazolines and oxazolines, e.g. 2-heptadecenyl-1-(2-hydroxyethyl)-imidazoline;

4.2.3. Sulfur-containing compounds: barium dinonyi-naphthalene sulfonates, calcium petroleum sulfonates, alkylthio-substituted aliphatic carboxylic acids, esters of aliphatic 2-sulfocarboxylic acids and salts thereof.

5. Examples of viscosity index enhancers: polyacrylates, polymethacrylates, vinylpyrrolidone/methacrylate copolymers, polyvinylpyrrolidones, polybutenes, olefin copolymers, styrene/acrylate copolymers, polyethers.

6. Examples of pour-point depressants: poly(meth)acrylates, ethylene/vinyl acetate copolymers, alkyl polystyrenes, fumarate copolymers, alkylated naphthalene derivatives.

7. Examples of dispersants/surfactants: polybutenylsuccinic acid amides or imides, polybutenylphosphonic acid derivatives, basic magnesium, calcium and barium sulfonates and phenolates.

8. Examples of extreme-pressure and anti-wear additives: sulfur- and halogen-containing compounds, e.g. chlorinated paraffins, sulfurized olefins or vegetable oils (soybean oil, rape oil), alkyl- or aryl-di- or -tri-sulfides, benzotriazoles or derivatives thereof, such as bis (2-ethylhexyl) aminomethyl tolutriazoles, dithiocarbamates, such as methylene-bis-dibutyidithiocarbamate, derivatives of 2-mercaptobenzothiazole, such as 1-[N,N-bis(2-ethylhexyl) aminomethyl]-2-mercapto-1H-1,3-benzothiazole, derivatives of 2,5-dimercapto-1,3,4-thiadiazole, such as 2,5-bis (tert-nonyidithio)-1,3,4-thiadiazole.

9 Examples of coefficient of friction reducers: lard oil, oleic acid, tallow, rape oil, sulfurized fats, amides, amines. Further examples are given in EP-A-0 565 487.

10. Examples of special additives for use in water/oil metal-working fluids and hydraulic fluids:

Emulsifiers: petroleum sulfonates, amines, such as poly-oxyethylated fatty amines, non-ionic surface-active substances; buffers: such as alkanolamines; biocides: triazines, thiazolinones, tris-nitromethane, morpholine, sodium pyridenethiol; processing speed improvers: calcium and barium sulfonates.

The above-mentioned components may be admixed with the above-mentioned, components a)–d) in a manner known per se. It is also possible to prepare a concentrate or a so-called "additive pack", which can be diluted to give the working concentrations for the intended lubricant.

A preferred embodiment of the invention relates to a composition which comprises:

a) a base oil of lubricating viscosity used for engine oils, gear fluids or hydraulic fluids;

b) at least one phenol of the formula (I), wherein $R_1$ represents branched $C_8$–$C_{18}$alkyl;

c) at least one aromatic amine of the formula:

(II'),

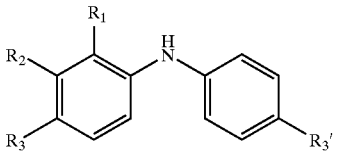

wherein $R_1$ and $R_2$ represent hydrogen or together represent the group:

(A)

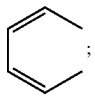

and one of $R_3$ and $R_3'$ represents hydrogen and the other one $C_8$–$C_{18}$alkyl or both $R_3$ and $R_3'$ represent $C_8$–$C_{18}$alkyl;

d) at least one zinc dithiophosphate of the formula (III) wherein $R_1$ and $R_2$ represent branched $C_3$–$C_{18}$alkyl selected from the group consisting of isopropyl, sec.-butyl and tert.-butyl; and e) at least one customary oil additive.

A particularly preferred embodiment of the invention relates to a composition, which comprises:

a) a base oil of lubricating viscosity used for engine oils, gear fluids or hydraulic fluids;

b) at least one phenol of the formula (I), wherein $R_1$ consists of isooctyl types selected from the group consisting of 3,4-, 3,5- or 4,5-dimethyl-1-hexyl and 3- or 5-methyl-1-heptyl, or branched alkyl groups with more than 8 carbon atoms, wherein a side chain is attached in 2-position of the carbon chain selected from the group consisting of 2-n-butyl-n-octyl, 2-n-hexyl-n-decyl and 2-n-octyl-n-dodecyl;

c) at least one aromatic amine of the formula II', wherein $R_1$ and $R_2$ represent hydrogen or together represent the group (A), one of $R_3$ and $R_3'$ represents hydrogen and the other one branched octyl as obtained from a dimer of isobutylene, branched nonyl as obtained from a trimer of tripropylene, branched dodecyl obtained from a trimer of isobutylene or a tetramer of propylene, or branched pentadecyl obtained from a pentamer of propylene, or both $R_3$ and $R_3'$ represent branched octyl as obtained from a dimer of isobutylene, branched nonyl as obtained from a trimer of tripropylene, branched dodecyl obtained from a trimer of isobutylene or a tetramer of propylene, or branched pentadecyl obtained from a pentamer of propylene;

d) at least one zinc dithiophosphate of the formula (III) wherein $R_1$ and $R_2$ represent branched $C_3$–$C_{18}$alkyl selected from the group consisting of isopropyl, sec.-butyl and tert.-butyl; and e) at least one customary oil additive.

High preference is given to a preferred embodiment of the invention that relates to a composition, which comprises:

a) a base oil of lubricating viscosity used for engine oils, gear fluids or hydraulic fluids;

b) at least one phenol of the formula (I), wherein $R_1$ represents isooctyl types selected from the group consisting of 3,4-, 3,5- or 4,5-dimethyl-1-hexyl and 3- or 5-methyl-1-heptyl;

c) at least one aromatic amine of the formula II', wherein $R_1$ and $R_2$ represent hydrogen or together represent the group (A) and one of $R_3$ and $R_3'$ represents hydrogen and the other one 1,4,4-trimethyl-2-pentyl or straight chained or branched nonyl or both $R_3$ and $R_3^{1'}$ represent 1,4,4-trimethyl-2-pentyl or straight chainedor branched nonyl;

d) at least one zinc dithiophosphate of the formula (III) wherein $R_1$ and $R_2$represent branched $C_3$–$C_{18}$alkyl selected from the group consisting of isopropyl, sec.-butyl and tert.-butyl; and e) at least one customary oil additive.

Highest preference is given to a preferred embodiment of the invention that relates to a composition, which comprises:

a) a base oil of lubricating viscosity used for engine oils, gear fluids or hydraulic fluids;

b) 0.2–3.0 weight-% of at least one phenol of the formula (I), wherein $R_1$ represent isooctyl types selected from the group consisting of 3,4-, 3,5- or 4,5-dimethyl-1-hexyl and 3- or 5-methyl-1-heptyl;

c) 0.1–1.5 weight-% of at least one aromatic amine of the formula II', wherein $R_1$ and $R_2$ represent hydrogen or together represent the group (A) and one of $R_3$ and $R_3'$ represents hydrogen and the other one 1,4,4-trimethyl-2-pentyl or straight chained or branched nonyl or both $R_3$ and $R_3'$ represent 1,4,4-trimethyl-2-pentyl or straight chained or branched nonyl;

d) 0.01–0.05% (weight-% P) of at least one zinc dithiophosphate of the formula (III) wherein $R_1$ and $R_2$represent branched $C_3$–$C_{18}$alkyl selected from the group consisting of isopropyl, sec.-butyl and tert.-butyl; and e) 0.1–1.0 weight-% of at least one customary oil additive.

The present invention also relates to a concentrate that can be used in the preparation for a composition which comprises:

b) at least one phenol of the formula I, wherein $R_1$ represents branched $C_8$–$C_{22}$alkyl;

c) at least one aromatic amine of the formula II, wherein $R_1$ and $R_2$ represent hydrogen or together represent the group A and one of $R_3$ and $R_3'$ represents hydrogen and the other one $C_2$–$C_{30}$alkyl or both $R_3$ and $R_3'$ represent $C_2$–$C_{30}$alkyl;

d) at least one zinc dithiophosphate of the formula II, wherein $R_1$ and $R_2$represent straight chained or branched $C_3$–$C_{20}$alkyl.

The oil additives mentioned above under component e) are optionally present in the concentrate. The components are combined in the concentrate that the concentrate is fluid at room temperature without the addition of the base oil a) or a solvent.

The invention also relates to a process for preventing or reducing black sludge formation in lubricating oils for combustion engines; for keeping black sludge particles in suspension in the lubricating oil; and for reducing black sludge deposits in the lubricating system of spark-ignition internal combustion engines, which comprises applying to the lubrication system the composition defined above.

The invention relates also to a method of improving the performance properties of lubricants, which comprises adding to the lubricant at least one composition as defined above.

The invention relates also to the use of compounds of components b), c) and d), and optionally e), preferably in the mentioned concentration, as additives in motor oils, turbine oils, gear oils, hydraulic fluids, metal-working fluids or lubricating greases.

The following Examples illustrate the invention:

EXAMPLE 1

Deposit and Oxidation Panel Test (DOPT)

Method

The Deposit and Oxidation Panel Test (DOPT) is derived from a test method for engine oils, in particular Diesel engine oils, which has been described by G. Abellaneda et al. IIIrd Symposium CEC, 1989, 61, New Cavendish Str. London WIM 8AR, England. The suitability of the oils with different antioxidants for preventing deposits on the pistons is tested. The test time is 20 hours, the panel temperature 260° C. and the oil flex 1 ml/ minute. The humid atmospheric environment is enriched with 260 ppm $NO_2$ and 26 ppm $SO_2$. After the test, the metal panel onto which the oil drops, is weighed and assessed visually. The lower the numbers, the better. The lubricating oil used is a commercial CD oil which is diluted with the basic oil STANCO 150. The antioxidants listed below are admixed to this base fluid with the amounts indicated in TABLE 1 and this composition is then subjected to DOPT.

Antioxidants Tested

Test Compound 1)

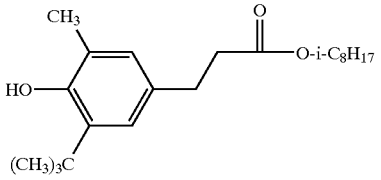

Test Compound 2)

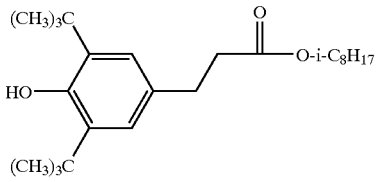

Compositions Tested

TABLE 1

| Components | Test Composition 1 [%] | Test Composition 2 [%] | Control |
|---|---|---|---|
| Base fluid | 97.80 | 97.80 | 97.80 |
| Test Compound 1 | 2.00 | | |
| Test Compound 2 | | 2.00 | |
| IRGANOX ® L 57[1)] | 0.10 | 0.10 | 0.10 |
| Zinc dithiophosphate[2)] | 0.02 | 0.02 | 0.02 |

[1)]Octylated diphenylamine;
[2)]prim. /sec. as % P

Results

TABLE 2

| Test Composition → | 1 | 2 | Control |
|---|---|---|---|
| Deposit (mg) | 36 | 79 | 126 |
| Aspect (demerit) | 7 | 12 | 18 |
| Ester (abs. $cm^{-1}$) | 3.5 | 11.8 | 31.9 |

EXAMPLE 2

Deposit and Oxidation Panel Test (DOPT)

Method

The method as described above in Example 1 is applied.

Antioxidants Tested

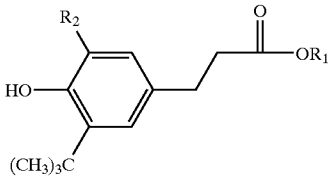

Test Compound 1) $R_1$: 2-n-butyl-n-octyl:

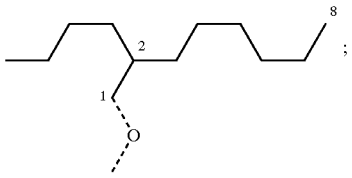

$R_2$; $CH_3$

Test Compound 2) $R_1$: 2-n-butyl-n-octyl; $R_2$: $C(CH_3)_3$

Test Compound 3) $R_1$: 2-n-hexyl-n-decyl:

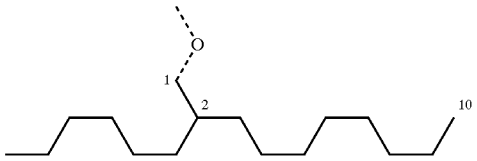

$R_2$; $CH_3$

Test Compound 4) $R_1$: 2-n-hexyl-n-decyl; $R_2$: $C(CH_3)_3$

Test Compound 5) $R_1$: 2-n-octyl-n-dodecyl:

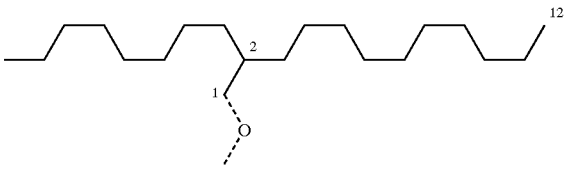

$R_2$; $CH_3$

Test Compound 6) $R_1$: 2-n-octyl-n-dodecyl; $R_2$: $C(CH_3)_3$

Compositions Tested

TABLE 3

| Components | Test Composition 1 [%] | 2 [%] | 3 [%] | 4 [%] | 5 [%] | 6 [%] | Control |
|---|---|---|---|---|---|---|---|
| Base fluid | 97.80 | 97.80 | 97.80 | 97.80 | 97.80 | 97.80 | 97.80 |
| Test Compound 1 | 2.00 | | | | | | |
| Test Compound 2 | | 2.00 | | | | | |
| Test Compound 3 | | | 2.00 | | | | |
| Test Compound 4 | | | | 2.00 | | | |
| Test Compound 5 | | | | | 2.00 | | |
| Test Compound 6 | | | | | | 2.00 | |
| IRGANOX ®L57[1)] | 0.10 | 0.10 | 0.10 | 0.10 | 0.10 | | 0.10 |
| Zinc dithiophosphate[2)] | 0.02 | 0.02 | 0.02 | 0.02 | 0.02 | | 0.02 |

[1)]octylated diphenylamine;
[2)]prim./sec. as % P

Results

TABLE 4

| | Test Composition 1 | 2 | 3 | 4 | 5 | 6 | Control |
|---|---|---|---|---|---|---|---|
| Deposit (mg) | 44 | 59 | 50 | 86 | 31 | 114 | 126 |
| Aspect (demerit) | 10 | 12 | 11 | 13 | 10 | 15 | 18 |
| Ester (abs. $cm^{-1}$) | 8.7 | 10.0 | 9.7 | 11.2 | 8.9 | 18 | 31.9 |

EXAMPLE 3

PDSC: Pressurized Differential Scanning Calorimetry

PDSC is an accepted method for the assessment of engine oil. It is used by the ACEA (Association des constructeurs europeens d'automobiles) to define the heavy-duty Diesel engine oil category ES.

Method

The instrument used is a DSC27HP apparatus of the METTLER TA-8000 series (Mettler-Toledo, CH-Greifensee). The heat flow to the sample is determined as the difference of the heat flows to the sample crucible and the reference crucible. Heat adsorption by the sample indicates an endothermic reaction, e.g. a melting process.

A sample crucible containing 2.0 mg of a defined test composition is positioned on the sensor together with an inert reference crucible, both made of aluminum. The sealed cell is thoroughly flushed several times with the reaction gas, air and then placed under a pressure of 10 bar. At a heating rate of 50°/min, heating from room temperature to the reaction temperature of 220° is carried out.

The induction period is used as the evaluation criterion. The induction period is the period in which the oxidation reaction visibly commences, formed by the point where the base line of the sensor intersects the tangent of the reaction signal.

Compositions Tested

TABLE 5

| Components | Test Composition 1 [%] | Test Composition 2 [%] | Control |
|---|---|---|---|
| Base fluid | 97.0 | 97.0 | 97.0 |
| Test Compound 1[1)] | 0.89 | | |

TABLE 5-continued

| Components | Test Composition 1 [%] | Test Composition 2 [%] | Control |
|---|---|---|---|
| Test Compound 2[2)] | | 1.00 | |
| IRGANOX ® L 57[3)] | 0.30 | 0.30 | 0.30 |
| Zinc dithiophosphate[3)] | 0.1 | 0.1 | 0.1 |

[1)] [2)]cf. Example 1;
[3)]octylated diphenylamine;
[4)]prim./sec. as % P

Results

TABLE 6

| Test Composition → | 1 | 2 | Control |
|---|---|---|---|
| PDSC[1)] | 48 | 37 | 29 ± 1 |

[1)]induction

What is claimed is:

1. A composition which comprises:

a) a base oil of suitable viscosity for lubricating internal combustion engines;

b) at least one phenol of the formula:

(I)

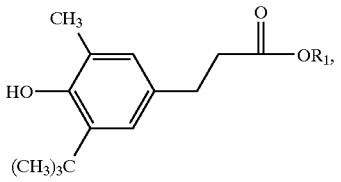

wherein $R_1$ represents branched $C_8$–$C_{22}$alkyl;

c) at least one aromatic amine of the formula:

(II)

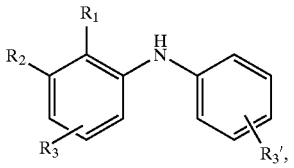

wherein $R_1$ and $R_2$ represent hydrogen or together represent the group:

(A)

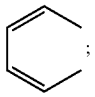

;

and one of $R_3$ and $R_3'$ represents hydrogen and the other one $C_2$–$C_{30}$alkyl or both $R_3$ and $R_3'$ represent $C_2$–$C_{30}$alkyl; and d) at least one zinc dithiophosphate of the formula (III)

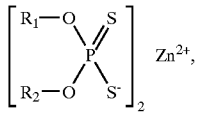

wherein $R_1$ and $R_2$ represent straight chained or branched $C_3$–$C_{20}$alkyl.

2. A composition according to claim 1 which comprises:

a) a base oil of suitable viscosity for lubricating internal combustion engines;

b) at least one phenol of the formula (I), wherein $R_1$ represents branched $C_8$–$C_{18}$alkyl;

c) at least one aromatic amine of the formula:

(II')

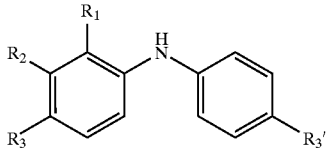

wherein $R_1$ and $R_2$ represent hydrogen or together represent the group:

(A)

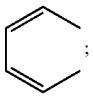

and one of $R_3$ and $R_3$' represents hydrogen and the other one $C_2$–$C_{18}$alkyl or both $R_3$ and $R_3$' represent $C_2$–$C_{18}$alkyl;

d) at least one zinc dithiophosphate of the formula (III) wherein $R_1$ and $R_2$ represent branched $C_3$–$C_{18}$alkyl selected from the group consisting of isopropyl, sec.-butyl and tert.-butyl; and e) at least one customary internal combustion engine oil additive.

3. A composition according to claim 1 which comprises:

a) a base oil of suitable viscosity for lubricating internal combustion engines;

b) at least one phenol of the formula (I), wherein $R_1$ consists of isooctyl radicals selected from the group consisting of 3,4-, 3,5- or 4,5-dimethyl-1-hexyl and 3- or 5-methyl-1-heptyl, or branched alkyl groups with more than 8 carbon atoms, wherein a side chain is attached in 2-position of the carbon chain selected from the group consisting of 2-n-butyl-n-octyl, 2-n-hexyl-n-decyl and 2-n-octyl-n-dodecyl;

c) at least one aromatic amine of the formula II', wherein $R_1$ and $R_2$ represent hydrogen or together represent the group (A), one of $R_3$ and $R_3$' represents hydrogen and the other one branched octyl as obtained from a dimer of isobutylene, branched nonyl as obtained from a trimer of tripropylene, branched dodecyl obtained from a trimer of isobutylene or a tetramer of propylene, or branched pentadecyl obtained from a pentamer of propylene, or both $R_3$ and $R_3$' represent branched octyl as obtained from a dimer of isobutylene, branched nonyl as obtained from a trimer of tripropylene, branched dodecyl obtained from a trimer of isobutylene or a tetramer of propylene, or branched pentadecyl obtained from a pentamer of propylene;

d) at least one zinc dithiophosphate of the formula (III) wherein $R_1$ and $R_2$ represent branched $C_3$–$C_{18}$alkyl selected from the group consisting of isopropyl, sec.-butyl and tert.-butyl; and e) at least one customary internal combustion engine oil additive.

4. A composition according to claim 1 which comprises:

a) a base oil of suitable viscosity for lubricating internal combustion engines;

b) at least one phenol of the formula (I), wherein $R_1$ represents isooctyl radicals selected from the group consisting of 3,4-, 3,5- or 4,5-dimethyl-1-hexyl and 3- or 5-methyl-1-heptyl;

c) at least one aromatic amine of the formula II', wherein $R_1$ and $R_2$ represent hydrogen or together represent the group (A) and one of $R_3$ and $R_3$' represents hydrogen and the other one 1,4,4-trimethyl-2-pentyl or straight chained or branched nonyl or both $R_3$ and $R_3$' represent 1,4,4-trimethyl-2-pentyl or straight chained or branched nonyl;

d) at least one zinc dithiophosphate of the formula (III) wherein $R_1$ and $R_2$ represent branched $C_3$–$C_{18}$alkyl selected from the group consisting of isopropyl, sec.-butyl and tert.-butyl; and e) at least one customary internal combustion engine oil additive.

5. A composition according to claim 1 which comprises:

a) a base oil of suitable viscosity for lubricating internal combustion engines;

b) 0.2–3.0 weight-% of at least one phenol of the formula (I), wherein $R_1$ represents isooctyl radicals selected from the group consisting of 3,4-, 3,5- or 4,5-dimethyl-1-hexyl and 3- or 5-methyl-1-heptyl;

c) 0.1–1.5 weight-% of at least one aromatic amine of the formula II', wherein $R_1$ and $R_2$ represent hydrogen or together represent the group (A) and one of $R_3$ and $R_3$' represents hydrogen and the other one 1,4,4-trimethyl-2-pentyl or straight chained or branched nonyl or both $R_3$ and $R_3$' represent 1,4,4-trimethyl-2-pentyl or straight chained or branched nonyl;

d) 0.01–0.05% (weight-% P) of at least one zinc dithiophosphate of the formula (III) wherein $R_1$ and $R_2$ represent branched $C_3$–$C_{18}$alkyl selected from the group consisting of isopropyl, sec.-butyl and tert.-butyl; and e) 0.1–1.0 weight-% of at least one customary internal combustion engine oil additive.

6. A composition according to claim 1, wherein the base oil of lubricating viscosity of component a) consists of an oil for spark-ignition internal combustion engines.

7. A process for preventing or reducing black sludge formation in lubricating oils for combustion engines; for keeping black sludge particles in suspension in the lubricating oil; and for reducing black sludge deposits in the lubricating system of spark-ignition internal combustion engines, which comprises applying to the lubrication system a composition according to claim 1.

8. A method of improving the performance properties of a lubricant used in internal combustion engines, which comprises adding to the lubricant an effective lubricating amount of at least one composition according to claim 1.

* * * * *